US005472487A

United States Patent [19]

Chin et al.

[11] Patent Number: 5,472,487

[45] Date of Patent: Dec. 5, 1995

[54] MOLYBDENUM DISILICIDE BASED MATERIALS WITH REDUCED COEFFICIENTS OF THERMAL EXPANSION

[75] Inventors: Stephen Chin, Wallingford; Norman S. Bornstein, West Hartford, both of Conn.

[73] Assignee: United Technologies Corporation, Hartford, Conn.

[21] Appl. No.: 644,169

[22] Filed: Jan. 18, 1991

[51] Int. Cl.[6] ..... C09K 3/00

[52] U.S. Cl. ..... 106/287.11; 106/287.1; 106/207.13; 106/287.34; 419/9; 419/13; 419/17; 419/19; 427/450; 427/452; 428/552; 428/564

[58] Field of Search ..... 419/9, 17, 13, 419/19; 427/38, 450, 452; 428/552, 564; 106/287.1, 287.11, 287.13, 290, 287.34

[56] References Cited

U.S. PATENT DOCUMENTS

| | | | |
|---|---|---|---|
| 3,688,018 | 8/1972 | Hiscocks | 428/611 |
| 3,723,165 | 3/1973 | Longo et al. | 117/93.1 |
| 4,696,855 | 9/1987 | Pettit, Jr. et al. | 428/312 |
| 4,888,247 | 12/1989 | Zweben et al. | 428/457 |
| 4,912,542 | 3/1990 | Suguro | 428/620 |
| 4,916,030 | 4/1990 | Christodoulou et al. | 428/614 |

OTHER PUBLICATIONS

Henne, Rudolf and Weber, Winfried, "Progress in the Development of High–Temperature Oxidation–Preventing Coatings For Molybdenum By Application of the Low–Pressure Plasma–Spraying Method", High Temperatures–High Pressures, 1986, vol. 18, pp. 223–232.

*Primary Examiner*—Stephen J. Lechert, Jr.
*Attorney, Agent, or Firm*—Charles E. Sohl

[57] ABSTRACT

Molybdenum disilicide base materials and methods for producing them are described. Mixtures of $MoSi_2$ powder and other powders including $SiO_2$, $Si_3N_4$, SiC and $Mo_5Si_3$ are plasma sprayed. Another embodiment which involves oxidation of $MoSi_2$ is also disclosed. The resistant materials have particular utility as coatings for Nb alloys.

11 Claims, 2 Drawing Sheets

MOLYBDENUM DISILICIDE BASED MATERIALS WITH REDUCED COEFFICIENTS OF THERMAL EXPANSION

This invention was made under a Government contract and the Government has rights therein.

TECHNICAL FIELD

This invention relates to the field of molybdenum disilicide based materials, and particularly to coatings based on molybdenum disilicide ($MoSi_2$) having reduced coefficients of thermal expansion.

BACKGROUND ART

Alloys which are usable at elevated temperatures find widespread application, particularly the gas turbine field, and other fields including furnaces and other thermal processing equipment. Most alloys used in gas turbine engines are based on nickel. Nickel alloys, usually referred to as superalloys, have useful strengths of up to about 2200° F. Nickel base superalloys are now being used very near their melting points and significant increases in use temperature will undoubtedly require the adoption of different alloy systems.

It is known that the so-called refractory metals, molybdenum, tungsten, tantalum, and niobium have exceptionally high melting points. Of these, niobium has other favorable properties, and considerable efforts were made to develop niobium based alloys in the 1950s and 1960s. These efforts failed because of the oxidation susceptibility of niobium.

In the field of high temperature materials, it is common practice to use protective coatings to provide oxidation resistance to materials which have useful properties, but lack inherent oxidation resistance. In the development of niobium alloys, efforts were made to use refractory silicide coatings, but without significant success. The coatings developed had a coefficient of thermal expansion substantially greater than that of the niobium substrate, and were characterized by significant cracking. Cracking permitted the passage of oxygen through the coating into the substrate, causing early substrate failure. In current, very limited usage of niobium alloys in gas turbine engines, silicide coatings are used, but the problems relating to cracking persist.

In a prior application, U.S. Ser. No. 07/286,835 filed on Dec. 20, 1988, it was proposed to use a two layer coating system to protect niobium and niobium based alloys. This case has been indicated as being allowable and the contents thereof are incorporated herein by reference. The coating system comprised a first coating of $Ta_5Si_3$, and/or $Nb_5Si_3$ on the substrate with an outer layer comprised essentially of $MoSi_2$. The theory behind this dual layer coating system was that the first layer provided diffusional stability by minimizing the diffusion of silicon from the $MoSi_2$ into the substrate, and the $MoSi_2$ layer provided oxidation resistance. Upon more extensive testing of this coating, it has been found to have a mismatch in coefficient of thermal expansion between the niobium substrate and the coating and is prone to crack when subjected to thermal cycling.

DISCLOSURE OF INVENTION

According to the present invention, molybdenum disilicide has its inherent coefficient of thermal expansion reduced by being mixed with other oxidation resistant materials which have reduced coefficients of thermal expansions. These materials comprise $Mo_5Si_3$, SiC, $Si_3N_4$, and $SiO_2$. Mixtures of these phases in molybdenum disilicide are also contemplated. Broadly speaking, the invention material will comprise continuous molybdenum disilicide matrix containing from about ten to about seventy volume percent of one or more of the previously enumerated phases and mixtures thereof.

BEST MODE FOR CARRYING OUT THE INVENTION

Figure 1:
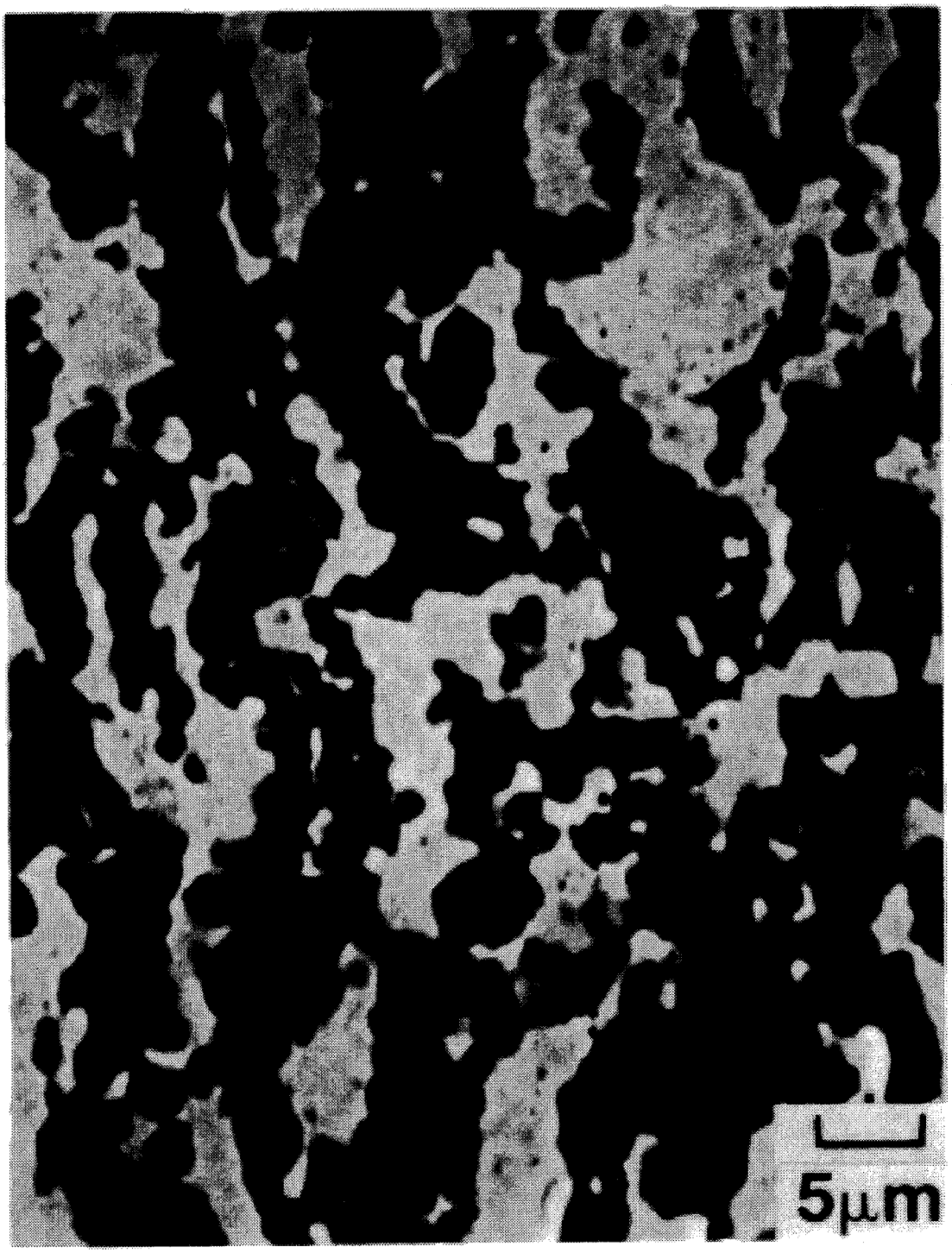
FIG. 1 is a photomicrograph of an $MoSi_2$ coating containing $Mo_5Si_3$.

Table I lists the coefficient of thermal expansion in parts per million per degree C. of mixtures of molybdenum disilicide and $Mo_5Si_3$, SiC, $Si_3N_4$, and $SiO_2$. Also shown are the coefficients of thermal expansion for pure $MoSi_2$ and pure niobium. It can be seen that the coefficient of $MoSi_2$ at 9.2 is significantly greater than that of niobium at 7.9. It can also be seen that adding varying amounts of the previously numerated elements is predicted to reduce the coefficient expansion of $MoSi_2$ substantially. It should be noted that the data in Table I is not based on a simple rule of mixtures calculation, but instead uses a more complex equation developed by Kerner (Kerner, E. H., Proc. Phys. Soc., London, B69, 808,1956) which takes into account other factors including shear modulus and bulk modulus.

The present invention teaches methods to produce material such as those described in Table I using plasma spray techniques along with varying methods of powder production, different spray nozzle designs, and, in one case, the use of a reactive gas during plasma spraying.

The invention employs low pressure plasma spraying. In this process, the plasma spray process is performed in a chamber which is held at a sub-atmospheric pressure (typically 0.02–0.25 Atm). In the performance of the present invention, the cleaning process known as reverse transfer arc cleaning is preferably employed and the substrate is heated to about 1500° F. during the deposition process.

Table II lists the various additive constituents contemplated, along with the fabrication processes dealt with in the present invention, and indicates the suitability of the particular process for producing materials containing these particular additive constituents.

The notation "pre-blend" means that powders of $MoSi_2$ and the additive material(s) are mixed prior to being introduced to the plasma torch, and are thereafter plasma sprayed together. The drawback of this approach is that success requires that the materials be similar in properties, particularly in melting point and vapor pressure.

For materials which have substantially different properties, a more appropriate approach is that which is referred to as co-spray. In this approach, the different materials are introduced into the plasma at different points in the flame so that the heating time in the plasma produces the desired result in each material which is to be sprayed. Thus, when it is desired to spray two materials which have greatly different melting points, the high melting point species is injected into the plasma fairly near the point of plasma initiation, and the low melting point material is introduced downstream. This provides a longer residency time in the flame for the melting point material, so that achieves a similar state of melting/softening as that developed by the low melting point material, which experiences a short flame residency. The co-spray process will generally be successful with all of the suggested second phases. Reference should be made to U.S. Pat. Nos. 4,696,855 and 3,723,165 which respectively describe a plasma torch for the co-spray process, and an example of the co-spray process in which a plastic material is co-sprayed with a high melting point superalloy material. These issued patents are both incorporated herein by reference.

The agglomeration process involves mixing very fine powders of the materials which are to be combined. There are a variety of known agglomeration methods including sintering and pulverization; and spray drying. The agglomerated powders comprise mechanical combinations of the starting powders. Usually, the particle size of the starting materials is less than the particle size of the final material. Again, this process will be generally successful with all of the constituents listed.

The final process which this application deals with is a relatively distinctive process which is applicable only to $SiO_2$, $Mo_5Si_3$, and most preferably to mixtures of $SiO_2$ and $Mo_5Si_3$ (in $MoSi_2$) as second phases. This process involves the intentional addition of oxygen into the plasma environment. The high temperature conditions encountered in the plasma flame causes partial oxidation of the $MoSi_2$, producing of $SiO_2$ and/or $Mo_5Si_3$. By varying the plasma spraying conditions, it is possible to favor the formation of silica at the expense of $Mo_5Si_3$ or $Mo_5Si_3$ at the expense of silica, but this process will generally be most useful in forming mixtures of $SiO_2$ and $Mo_5Si_3$ in an $MoSi_2$ matrix. Oxygen or air may be be used and is preferably added into the torch near the exit portion of the gun to minimize gun deterioration from oxidation. Oxygen or air may be added through an extra port in the gun, or may be used as a carrier gas. Alternately, oxygen or air may be bled into the chamber itself, rather than into the gun.

It is of course possible to combine the additive constituents in a single $MoSi_2$ base material. For example, using co-spray, one could inject $MoSi_2$ powder at one port of the torch, SiC powder into another port, and $SiO_2$ in a third port to arrive at a material having an $MoSi_2$ matrix containing SiC and $SiO_2$.

Agglomeration can also be used to produce $MoSi_2$ with more than one additive phase. A single agglomerated powder might contain $MoSi_2$, SiC and $SiO_2$ for example. Agglomerated powder and another powder might also be co-sprayed or pre-blended. Likewise, multiple agglomerated powders can be pre-blended or co-sprayed.

It is also possible to use the in-situ oxidation process in combination with the other processes, thus, for example, by co-spraying $MoSi_2$ with $Si_3N_4$ material with added oxygen or air, one could produce a material comprising an $MoSi_2$ matrix, which contained $SiO_2$ and $Mo_5Si_3$, resulting from the in-situ oxidation process, and also containing $Si_3N_4$ particles.

The exact details of the various plasma spraying processes are necessarily left to be determined by the skilled artisan who will have no difficulty in successfully practicing the present invention, based on the present disclosure and the knowledge of one skilled in the art. This is especially true in view of the many possibilities which are obvious from consideration of Table II, as well as the inherent differences between different low pressure plasma spray apparatus.

The following illustrative examples will assist the skilled artisan to practice the present invention.

EXAMPLE 1

A Plasma Technic Vacuum Plasma Spray unit having a type F4MB gun with a seven millimeter nozzle was employed. 65 volume percent $MoSi_2$ and 35 volume percent $Mo_5Si_3$ powders were pre-blended before being fed into the gun. The powder particles were between 10 and 44 microns in diameter.

These particles were injected into the above described vacuum plasma spray gun using a feed apparatus which involved two liters per minute flow of an argon carrier gas. The powder feed rate was twenty grams per minute. This gun was operated using fifty liters per minute of argon as the primary gas, ten liters per minute of hydrogen as the secondary gas at a current of 550 amps and a voltage of 63 volts. The low pressure plasma chamber was held at a pressure of 150 millibars, and the plasma spray gun was held 300 millimeters from the C103 niobium alloy substrate.

A seven mil thick coating was produced on a niobium alloy substrate which was about four inches long and an half inch in diameter.

To test for crack susceptibility and microstructure, the coated sample was heat treated at 2800° F./2 hours in argon. This cycle has been shown to produce cracking in prior art disilicide based coatings. After this heat treatment, cracking was not observed and the microstructure is shown in FIG. 1. The microstructure which contained 65% $MoSi_2$ and 35% $Mo_5Si_3$ is shown in FIG. 1. This sample was tested in a furnace oxidation test by repeatedly heating it in a furnace having an air atmosphere at a temperature of 2500° F., followed by cooling it to room temperature, using a cycle of one hour in the furnace and fifteen minutes at ambient temperature. After over ten cycles in this test, the oxidation resistance was excellent and no spalling of the protective oxide scale or coating was observed.

EXAMPLE 2

This example utilized the use of the agglomerated powder technique. The same Plasma Technic vacuum spray unit, as described in Example 1, was used in this example. Agglomerated powder containing $MoSi_2$ and 40 volume percent $SiO_2$ was used which was less than forty-four microns in diameter and greater than ten microns in diameter. This powder was prepared by the spray drying process where fine powders (of 5 to 10 microns in diameter) of $MoSi_2$, $SiO_2$ and an organic binder is used to produce an agglomerate. Other agglomeration techniques such as sintering and crushing may also be used.

These particles were injected into the above described vacuum plasma spray gun using a feed apparatus which involved two liters per minute flow of an argon carrier gas. The powder feed rate was twenty grams per minute. This gun was operated using fifty liters per minute of argon as the primary gas, sixteen liters per minute of nitrogen as the secondary gas at a current of 700 amps and a voltage of 67 volts. The low pressure plasma chamber was held at a pressure of 150 millibars, and the plasma spray gun was held 250 millimeters from the C103 niobium alloy substrate.

A five mil thick coating was produced on a niobium alloy substrate which was about four inches long and an half inch in diameter.

Figure 2:
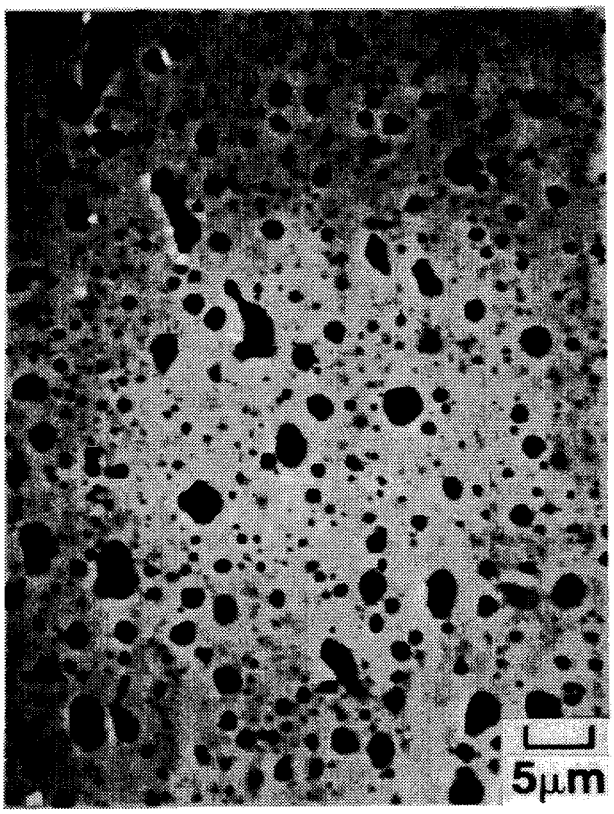
FIG. 2 is a photomicrograph of an $MoSi_2$ coating containing $SiO_2$.

The coated sample was heat treated at 2800° F. for 2 hours in argon. After this heat treatment, cracking was not observed and the microstructure is shown in FIG. 2. 16 volume percent of the dark phase which is $SiO_2$ and 84 volume percent of the gray phase which is $MoSi_2$ ware found.

This coated article was furnace oxidation tested as described above. After more than 15 cycles, the oxidation resistance was excellent and spalling of the oxide scale or coating was not observed.

EXAMPLE 3

This example employed the in-situ oxidation process. The same Plasma Technics vacuum plasma spray unit, as described in Example 1, was used in this example, and the parameters described in Example 1 relating to the gun operation were the same in this example, with the exception that pure $MoSi_2$ powder was fed into the gun using 3 liters per minute of argon as a carrier gas and 12 liters per minute of air was injected into a port in the gun at approximately the same axial location as the powder injection port.

A five mil thick coating was produced on a niobium alloy substrate which was about four inches long and an half inch in diameter.

Figure 3:
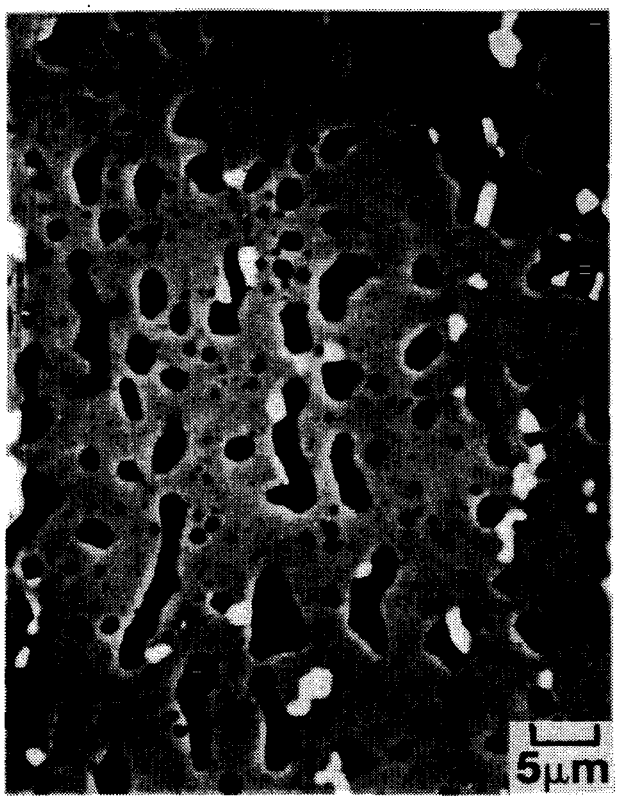
FIG. 3 is a photomicrograph of an $MoSi_2$ coating containing $Mo_5Si_3$ and $SiO_2$.

The coated sample was heat treated at 2800° F./2 hours in argon. After this heat treatment, cracking was not observed and the microstructure is shown in FIG. 3. 21 volume percent of the dark phase which is $SiO_2$, 2 volume percent of the light phase which is $Mo_5Si_3$ and 77 percent of the gray phase which is $MoSi_2$ were found.

This coated article was furnace oxidation tested as described above. After more than 15 cycles, the oxidation resistance was excellent and no spalling of the oxide scale or coating was observed. Additionally, more strenuous testing was performed in a burner rig in which petroleum fuel was combusted to produce a flame having a temperature of about 2500° F. which was impinged on a sample for a period of fifty-five minutes, and the sample was then cooled to below 500° F. using a five minute blast of forced air cooling. The sample withstood over fifty cycles of such testing without displaying coating cracking and the oxidation resistance was excellent and no spalling of the oxide scale or coating was observed.

The previously described plasma sprayed materials are appropriate for use as coatings on niobium alloys and other similar refractory materials provided that the coefficient of thermal expansion of the coating is adjusted to be approximately equal to that of the substrate. The invention materials potentially can also be plasma sprayed onto a ceramic substrate for use as heating elements or as power resistors for electronic applications.

We are aware that work has been done on structural materials comprised of an $MoSi_2$ matrix containing SiC particles. Materials such as these have, to our knowledge, been fabricated using hot pressing, hot isostatic pressing (HIP) and chemical vapor deposition of $MoSi_2$ onto an array of silicon carbide fibers. Aside from this, we are unaware that anyone has previously used $MoSi_2$ materials containing a continuous $MoSi_2$ matrix with silicon nitride, silica, $Mo_5Si_3$, $SiO_2$+$Mo_5Si_3$, and mixtures thereof. We believe that such materials have uses other than as coating materials.

Although the invention has been shown and described with respect to detailed embodiments thereof, it should be understood by those skilled in the art that various changes in form and detail thereof may be made without departing from the spirit and the scope of the claimed invention.

TABLE I

COEFFICIENT OF THERMAL EXPANSION OF VARIOUS MATERIALS AND CONCENTRATIONS IN $MoSi_2$

| | CTE (PPM/°C.) | | | | | |
|---|---|---|---|---|---|---|
| Material/vol. % | 0 | 10 | 20 | 35 | 50 | 100 |
| $Mo_5Si_3$ | 9.2 | 8.9 | 8.6 | 8.1 | 7.6 | 6.0 |
| SiC | 9.2 | 8.8 | 8.6 | 8.0 | 7.4 | 4.5 |
| $Si_3N_4$ | 9.2 | 8.6 | 8.0 | 6.9 | 6.0 | 3.0 |
| $SiO_2$ | 9.2 | 8.9 | 8.6 | 8.1 | 7.3 | 0.5 |

$MoSi_2$ = 9.2
Nb = 7.9

TABLE II

| Additive Phase | SiC | $Si_3N_4$ | $SiO_2$ | $Mo_5Si_3$ | $SiO_2$ + $Mo_5Si_3$ |
|---|---|---|---|---|---|
| Fabrication Process | | | | | |
| Pre-Blend | No | No | No | Yes | No |
| Co-Spray | Yes(1) | Yes(1) | Yes(1) | Yes(1) | Yes(1) |
| Agglomeration | Yes | Yes | Yes | Yes(1) | Yes |
| In-Situ Oxidation | No | No | Yes(2) | Yes(3) | Yes |

1. Not Tried
2. Difficult to Achieve w/o $Mo_5Si_3$ Formation
3. Difficult to Achieve w/o $SiO_2$ Formation

We claim:

1. A method for producing a coating consisting of an $MoSi_2$ matrix containing from about 10 to about 70 volume percent of a material selected from the group consisting of $SiO_2$, SiC, $Si_3N_4$, $Mo_5Si_3$, and mixtures thereof, on a substrate which comprises:

mixing $MoSi_2$ powder with powder of a material selected from the group consisting of SiC, $Si_3N_4$, $SiO_2$, $Mo_5Si_3$, and mixtures thereof, blending said powders to form a powder blend, and plasma spraying said powder blend onto a substrate.

2. A method for producing a coating consisting of an $MoSi_2$ matrix containing from about 10 to about 70 volume percent of a material selected from the group consisting of SiC, $Si_3N_4$, $SiO_2$, $Mo_5Si_3$, and mixtures thereof, on a substrate, which consists of using a plasma spray gun having multiple powder injection ports and introducing $MoSi_2$ powder into one of said injection ports, and injecting at least one material selected from the group consisting of SiC, $Si_3N_4$, $SiO_2$, $Mo_5Si_3$, and mixtures thereof into at least one other powder injection port, and plasma spraying said powders onto a substrate.

3. A method of producing a coating consisting of an $MoSi_2$ matrix containing from about 10 to about 70 volume percent of a material selected from the group consisting of SiC, $Si_3N_4$, $SiO_2$, $Mo_5Si_3$, and mixtures thereof, on a substrate, which comprises:

providing agglomerated powders of $MoSi_2$ and a material selected from the group consisting of SiC, $Si_3N_4$, $SiO_2$, and $Mo_5Si_3$, and mixtures thereof, and plasma spraying said agglomerated powder onto a substrate.

4. A method for producing a coating consisting of $MoSi_2$ and a second phase selected from the group consisting of $SiO_2$, $Mo_5Si_3$, and mixtures thereof, on a substrate, which comprises plasma spraying $MoSi_2$ from a plasma torch in an oxidizing atmosphere so as to form from about 10 to about 70 volume percent of said material selected from the group consisting of $SiO_2$, $Mo_5Si_3$, and mixtures thereof in said $MoSi_2$ matrix as a coating on a substrate.

5. A method as in claim 1 wherein the substrate is a niobium base alloy.

6. A method as in claim 2 in which said substrate is a niobium base alloy.

7. A method as in claim 3 wherein said substrate is a niobium base alloy.

8. A method as in claim 4 wherein said substrate is a niobium base alloy.

9. A material, formed by plasma spraying, which consists of an $MoSi_2$ matrix containing from 10 to 70 volume percent of second phases selected from the group consisting of SiC, $Si_3N_4$, $SiO_2$, $Mo_5Si_3$, and mixtures thereof.

10. A material consisting of a $MoSi_2$ matrix containing from 10 to 70 volume percent of a second phase selected from the group consisting of $Si_3N_4$, $SiO_2$, $Mo_5Si_3$, and mixtures thereof.

11. A material in claim 10 which further contains a phase based on SiC and has a total non $MoSi_2$ phase content of from about 10 to about 70 volume percent.

* * * * *